US007086694B1

(12) United States Patent
Huang

(10) Patent No.: US 7,086,694 B1
(45) Date of Patent: Aug. 8, 2006

(54) FOLDING CHAIR WITH A SAFETY DEVICE

(76) Inventor: Hsi-Chin Huang, No. 181, Wentzu Rd., Hsienhsi Hsiang, Changhua Hsien (TW)

( * ) Notice: Subject to any disclaimer, the term of this patent is extended or adjusted under 35 U.S.C. 154(b) by 0 days.

(21) Appl. No.: 11/045,110

(22) Filed: Jan. 31, 2005

(51) Int. Cl.
*A47C 4/00* (2006.01)

(52) U.S. Cl. ..... 297/39; 297/35

(58) Field of Classification Search ..... 297/16.1, 297/16.2, 35, 39, 452.13, 452.2
See application file for complete search history.

(56) References Cited

U.S. PATENT DOCUMENTS 4,536,026 A * 8/1985 Cornell ..... 297/39
5,054,848 A * 10/1991 Liu ..... 297/39
5,529,270 A * 6/1996 Liu ..... 297/31
5,707,105 A * 1/1998 Liu ..... 297/16.1
5,964,500 A * 10/1999 Lin ..... 297/39
6,062,639 A * 5/2000 Hill ..... 297/39
6,095,596 A * 8/2000 Chen ..... 297/39
6,517,151 B1 * 2/2003 Liu ..... 297/39
6,536,839 B1 * 3/2003 Liu ..... 297/39
6,595,582 B1 * 7/2003 Liu ..... 297/35
6,644,732 B1 * 11/2003 Lin ..... 297/39
2002/0175540 A1 * 11/2002 Liu ..... 297/16.1

* cited by examiner

*Primary Examiner*—Milton Nelson, Jr.
(74) *Attorney, Agent, or Firm*—Hershkovitz & Associates; Abe Hershkovitz

(57) ABSTRACT

The folding chair with a safety device has two folding links, a seat frame, a back frame, a rear leg, a front leg, two armrests and two locking sleeves. The seat frame, the back frame and the rear leg are attached pivotally to the folding links. The seat and back frames individually have a seat and a back. The seat frame has two ends and two latches that radially protrude from the seat frame respectively near the ends. The front leg is attached pivotally to the seat frame. The armrests are attached pivotally to the rear and front legs. The locking sleeves are rotatably mounted respectively on ends of the seat frame and individually have a tongue and a slot. The tongues selectively abut and hold the back frame. The slots are transversely formed through the sleeves and hold the latches.

5 Claims, 7 Drawing Sheets

FOLDING CHAIR WITH A SAFETY DEVICE

BACKGROUND OF THE INVENTION

1. Field of the Invention

The present invention relates to a folding chair, especially to a folding chair with a safety device.

2. Description of the Prior Arts

Folding chairs are used widely as temporary or recreational seating because folding chairs can be folded into a smaller volume when stowed. With reference to FIG. 6, a conventional folding chair (90) comprises two folding links (91), a U-shaped seat frame (92), a U-shaped back frame (93), a U-shaped front leg (94), a U-shaped rear leg (95), two armrests (96), chair body (97) and a seat rod (98). Each folding link (91) has a middle point (911), an upper point (912) and a lower point (913). The seat frame (92) is attached pivotally to the middle point (911) and has two ends. The back frame (93) is attached pivotally to the upper point (912). The front leg (94) is attached pivotally to the seat frame (92). The rear leg (95) is attached pivotally to the lower point (913). The armrests (96) are attached pivotally to the front leg (94) and the rear leg (95). The chair body (97) is mounted on the seat frame (92) and the back frame (93). The seat rod (98) has two ends. The ends of the seat rod (98) are mounted in the seat frame (92) near the ends, and the seat rod (98) holds the chair body (97) in position.

With further reference to FIG. 7, the conventional folding chair is not particularly stable. When a force is applied to the chair body (97) at or near the seat rod (98) without applying a force to the front of the seat frame (92), the conventional folding chair collapses easily and can be very dangerous. Furthermore, the folding chair is easy to collapse to clamp a child when the child stands on the folding chair.

To overcome the shortcomings, the present invention provides a folding chair with a safety device to mitigate or obviate the aforementioned problems.

SUMMARY OF THE INVENTION

The main objective of the present invention is to provide a folding chair with a safety device that will keep the folding chair from inadvertently collapsing. The folding chair with a safety device has two folding links, a seat frame, a back frame, a rear leg, a front leg, two armrests and two locking sleeves. The seat frame, the back frame and the rear leg are attached pivotally to the folding links. The seat and back frames individually have a seat and back mounted on the frames. The seat frame has two ends and two latches that radially protrude from the seat frame respectively near the ends. The front leg is attached pivotally to the seat frame. The armrests are attached pivotally to the rear and front legs. The locking sleeves are rotatably mounted respectively on ends of the seat frame, and individually have a tongue and a slot. The tongues selectively abut and hold the back frame. The slots are transversely formed respectively through the sleeves, hold the latches and selectively align the tongues to abut the back frame.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
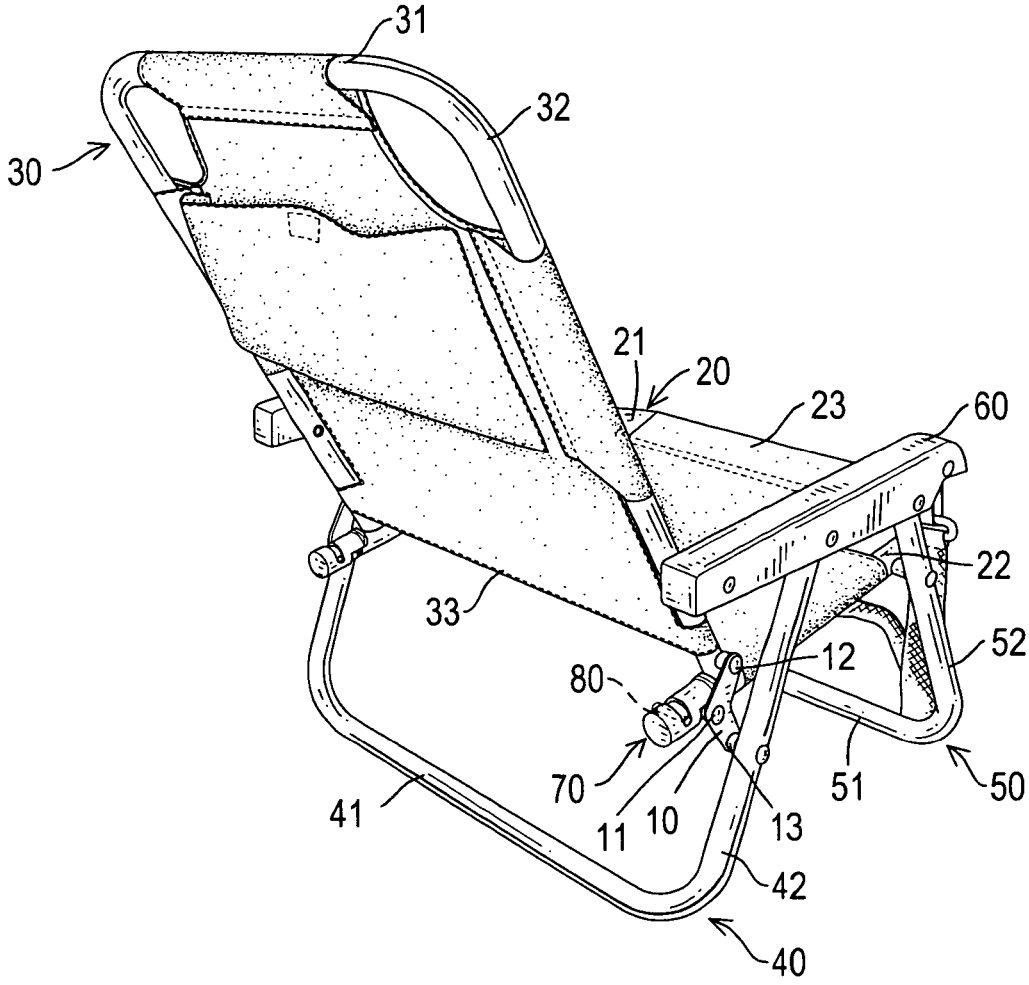
FIG. 1 is a perspective view of a first embodiment of a folding chair with a safety device in accordance with the present invention.

With reference to FIG. 1, a folding chair with a safety device in accordance with the present invention comprises two folding links (10), a seat frame (20), a back frame (30), a rear leg (40), a front leg (50), two armrests (60) and two locking sleeves (70).

Each folding link (10) may have a middle point (11), an upper end (12) and a lower end (13).

Figure 4:
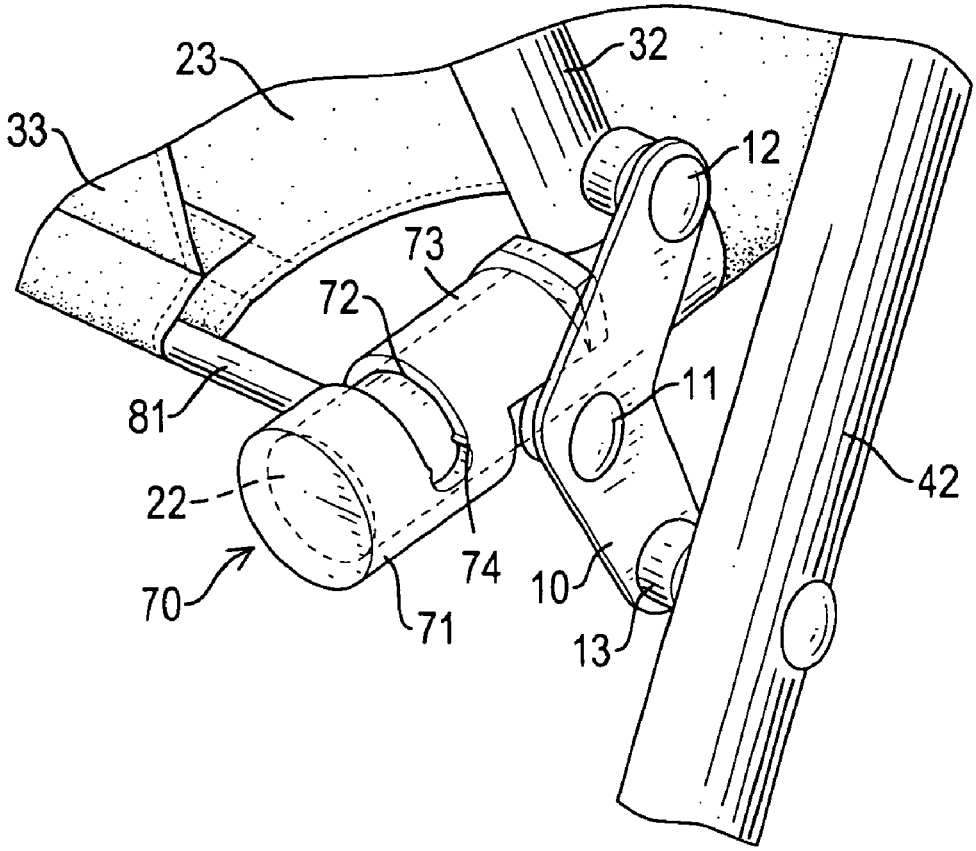
FIG. 4 is an enlarged perspective view of the safety device of the folding chair in FIG. 2.

The seat frame (20) is U-shaped, is attached pivotally to the folding links (10) and may have a transverse seat rod (21), two longitudinal seat rods (22), two latches (80) and a seat (23). The transverse seat rod (21) has two ends. The two longitudinal seat rods (22) are formed respectively on and extend perpendicularly from the two ends of the transverse seat rod (21) and are attached pivotally to the middle points (11) of the folding links (10), and each longitudinal seat rod (22) has a distal end and a through hole. The through holes are formed transversely through the longitudinal seat rods (22) respectively near the distal ends of the longitudinal seat rods (22) and have inside openings. The inside openings align with and face each other. The latches (80) are mounted respectively in the through holes and protrude from the inside openings to keep the locking sleeve (70) from dismounting the distal end of the longitudinal seat rods (22) of the seat frame (20), and each latch (80) may have an inside end and an optional head (801). The heads (801) are formed respectively on the inside ends of the latches (80). With further reference to FIG. 4, the two latches (80) may be formed as a single latch rod (81). The latch rod (81) is mounted in the through holes near the ends of the seat frame (20). The seat (23) is mounted on the transverse seat rod (21) and the longitudinal seat rods (22).

Figure 2:
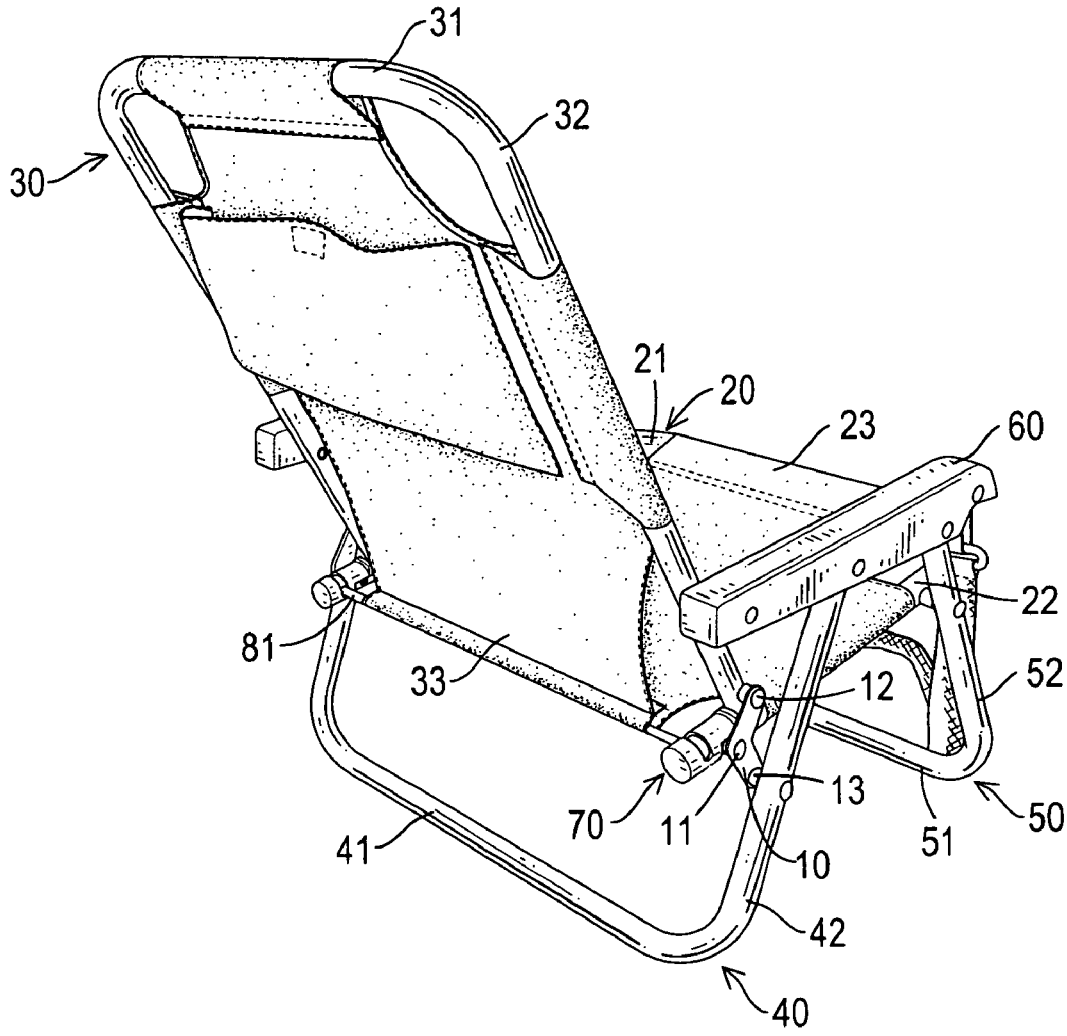
FIG. 2 is a perspective view of a second embodiment of a folding chair with a safety device in accordance with the present invention.

The back frame (30) is U-shaped, is attached pivotally to the folding links (10) and may have a transverse back rod (31), two longitudinal back rods (32) and a back (33). The transverse back rod (31) has two ends. The two longitudinal back rods (32) are formed respectively on and extend perpendicularly from the two ends of the transverse back rod (31), and each longitudinal back rod (32) has a distal end. The distal ends are pivotally attached respectively to the upper ends (12) of the folding links (10) and abut the longitudinal seat rods (22) of the seat frame (20) when the folding chair is open. With further reference to FIG. 2, the back (33) is mounted on the transverse back rod (31) and the longitudinal back rods (32). The back (33) and the seat (23) may be a single piece of upholstery that is held in position by the latch rod (81).

The rear leg (40) is U-shaped, is attached pivotally to the folding links (10) and may have a transverse rear rod (41) and two longitudinal rear rods (42). The transverse rear rod (41) has two ends. The two longitudinal rear rods (42) are formed respectively on and extend perpendicularly from the two ends of the transverse rear rod (41) and are attached pivotally to the lower end (13) of the folding links (10), and each longitudinal rear rod (42) has a distal end.

The front leg (50) is U-shaped, is attached pivotally to the seat frame (20) and may have a transverse front rod (51) and two longitudinal front rods (52). The transverse front rod (51) has two ends. The two longitudinal front rods (52) are formed respectively on and extend perpendicularly from the two ends of the transverse front rod (51) and are attached pivotally to the longitudinal seat rods (22) of the seat frame (20), and each longitudinal front rod (52) has a distal end.

The armrests (60) are pivotally attached respectively to the distal ends of the longitudinal rear rods (42) of the rear leg (40) and the distal ends of the longitudinal front rods (52) of the front leg (50).

Figure 3:
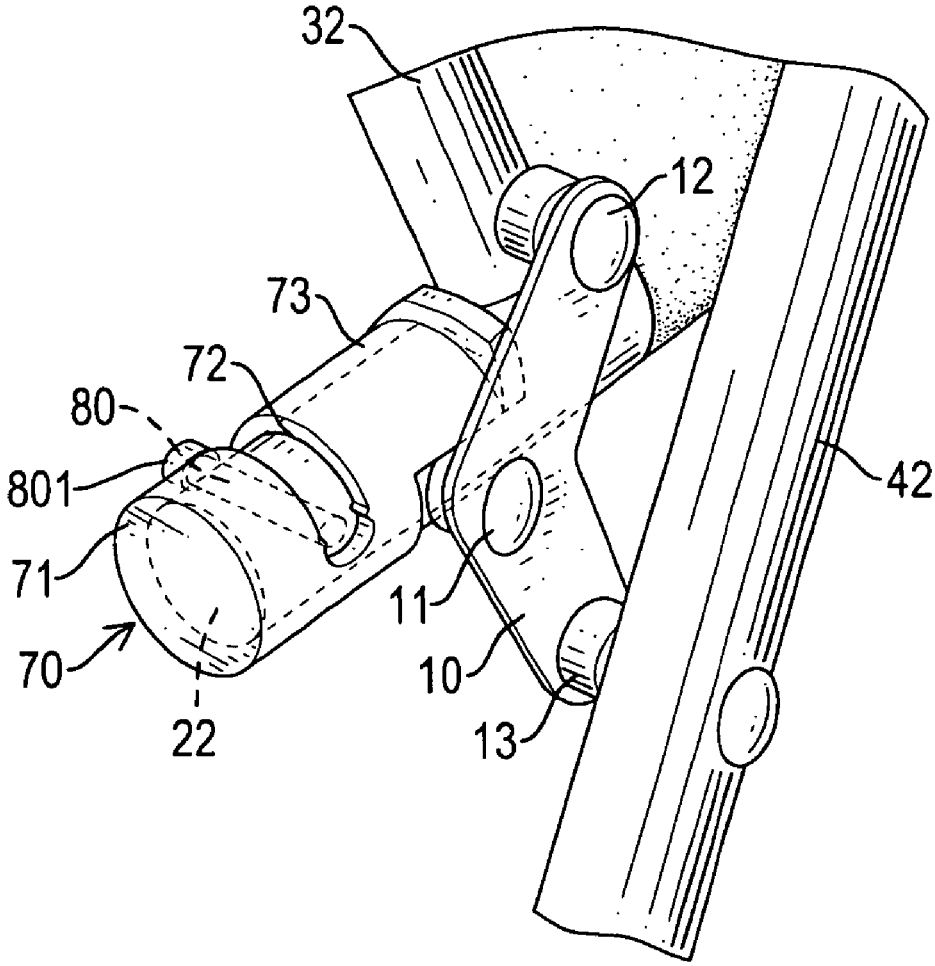
FIG. 3 is an enlarged perspective view of the safety device of the folding chair in FIG. 1.

With further reference to FIG. 3, the locking sleeves (70) are hollow and are rotatably mounted respectively on the distal ends of the longitudinal seat rods (22) of the seat frame (20). Each locking sleeve (70) has a body (71), a tongue (73), an optional slot (72) and two optional pairs of locking nubs (74). The body (71) is mounted around the distal end of the longitudinal seat rod (22) of the seat frame (20) and has a closed end and an open end. The tongue (73) is formed on and protrudes longitudinally from the open end of the body (71) and selectively abuts the longitudinal back rod (32) of the back frame (30) to keep the folding chair from folding. The slot (72) is formed transversely in the body (71), corresponds to the through hole in the longitudinal seat rod (22) of the seat frame (20) and has two ends. The pairs of the locking nubs (74) are formed respectively at ends of the slot (72).

Figure 5:
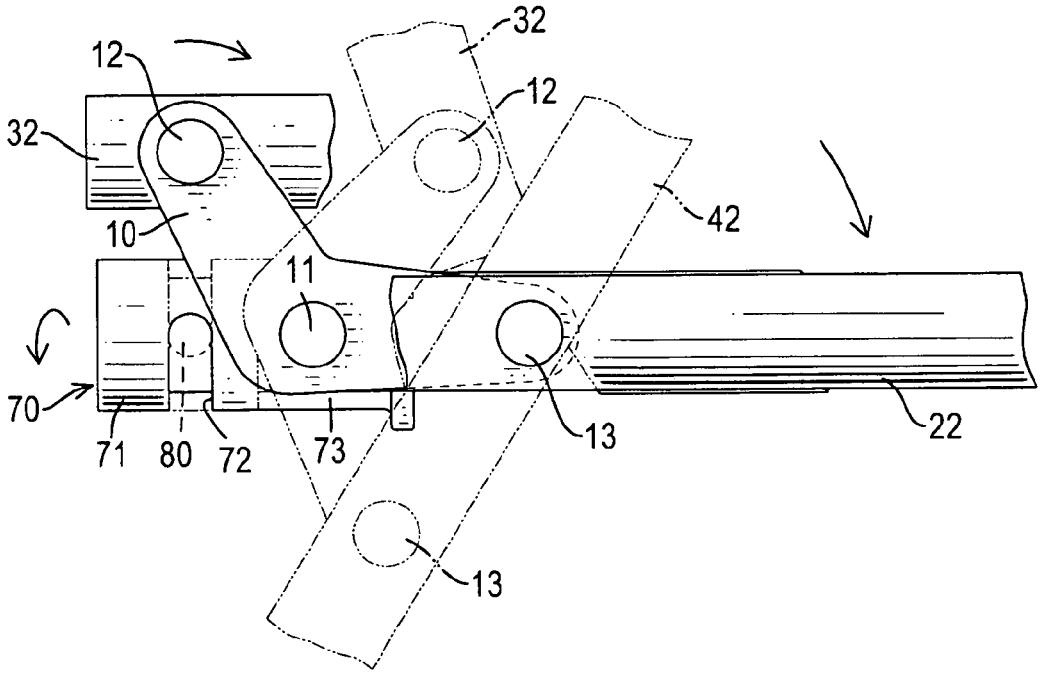
FIG. 5 is an enlarged operational side view of safety device in the folding chairs in FIGS. 1 and 2.
Figure 6:
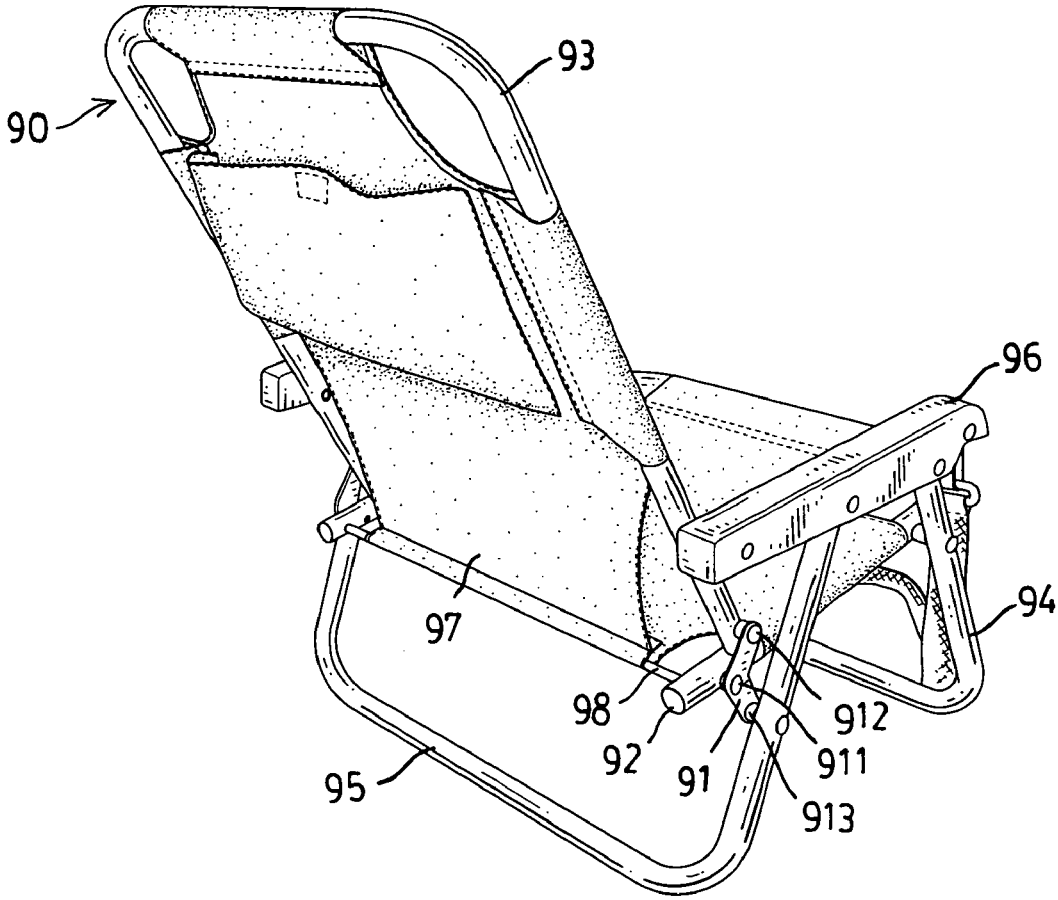
FIG.6 PRIOR ART
FIG. 6 is a perspective view of a conventional folding chair in accordance with the prior art.
Figure 7:
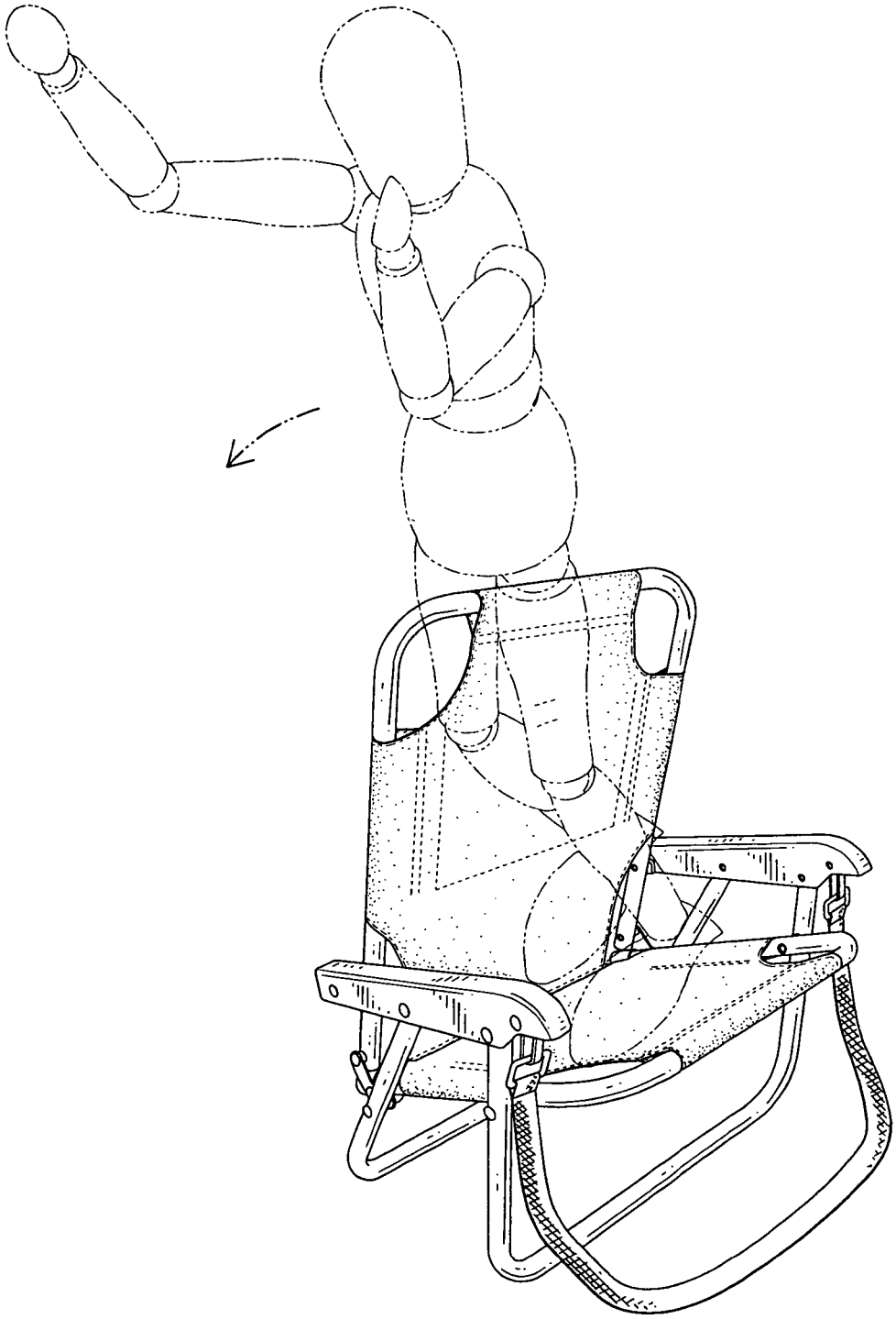
FIG.7 PRIOR ART
FIG. 7 is an operational perspective view of the conventional folding chair in FIG. 6.

When a force is applied to the folding chair at or near the latch rod (81) without applying a force to the front of the seat frame (20), the folding chair will not collapsed because the tongues (73) abut the longitudinal back rods (32) of the back frame (30). With further reference to FIG. 5, the folding chair is folded by rotating the locking sleeves (70) so the tongues (73) do not abut the longitudinal back rods (32) of the back frame (30). The longitudinal seat rods (22), the longitudinal back rods (32), the longitudinal rear rods (42) and the longitudinal front rods (52) are pivoted to align with one another to collapse the folding chair.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A folding chair with a safety device comprising:

two folding links having a middle point, an upper end and a lower end;

a U-shaped seat frame pivotally attached to the folding links and having a transverse seat rod having two ends, and two longitudinal seat rods formed respectively on and extending perpendicularly from the two ends of the transverse seat rod and pivotally attached to the middle points of the folding links, and each longitudinal seat rod having a distal end;

a through hole formed transversely through the longitudinal seat rod near the distal end of the longitudinal seat rod and having an inside opening;

two latches mounted respectively in the through holes which protrude from the inside openings;

a seat mounted on the transverse seat rod and the longitudinal seat rods;

a U-shaped back frame, pivotally attached to the folding links and having a transverse back rod having two ends, and two longitudinal back rods formed respectively on and extending perpendicularly from the two ends of the transverse back rod and pivotally attached to the upper end of the folding link and each longitudinal back rod having a distal end attached to the upper end of a folding link and abutting the longitudinal seat rod of the seat frame when the folding chair is opened;

a back mounted on the transverse back rod and the longitudinal back rods;

a U-shaped rear leg pivotally attached to the folding links and having a transverse rear rod having two ends, and two longitudinal rear rods formed respectively on and extending perpendicularly from the two ends of the transverse rear rod, attached pivotally to the lower end of the folding links, and each longitudinal rear rod having a distal end;

a U-shaped front leg pivotally attached to the seat frame and having a transverse front rod having two ends, and two longitudinal front rods formed respectively on and extending perpendicularly from the two ends of the transverse front rod and attached pivotally to the longitudinal seat rods of the seat frame, and each longitudinal front rod having a distal end;

two armrests pivotally attached respectively to the distal ends of the longitudinal rear rods of the rear leg and the distal ends of the longitudinal front rods of the front leg;

two hollow locking sleeves rotatably mounted respectively on the distal ends of the longitudinal seat rods of the seat frame, and each locking sleeve having a body mounted around the distal end of a corresponding one of the longitudinal seat rods of the seat frame and having a closed end and an open end;

a tongue formed on and protruding longitudinally from the open end of the body and selectively abutting a corresponding one of the longitudinal back rods of the back frame; and a slot formed transversely in the body, corresponding to the through hole in the longitudinal seat rod of the seat frame and having two ends.

2. The folding chair as claimed in claim 1, wherein each locking sleeve has two pairs of locking nubs, and the pairs of locking nubs are formed respectively at ends of the slot.

3. The folding chair as claimed in claim 1, wherein each latch has an inside end and a head formed on the inside end.

4. The folding chair as claimed in claim 1, wherein the two latches are formed as a single latch rod mounted in the through holes near the ends of the seat frame.

5. The folding chair as claimed in claim 4, wherein the back and the seat are a single piece of upholstery that is held in position by the latch rod.

* * * * *